US005962961A

United States Patent [19]

Sakai et al.

[11] Patent Number: 5,962,961

[45] Date of Patent: Oct. 5, 1999

[54] THERMAL FIELD EMISSION ELECTRON GUN

[75] Inventors: Iwao Sakai; Tokuo Mizuno, both of Tokyo, Japan

[73] Assignee: JEOL Ltd. and JEOL Engineering Co., Ltd., Tokyo, Japan

[21] Appl. No.: 08/968,267

[22] Filed: Nov. 12, 1997

[51] Int. Cl.[6] ..... H01J 1/16

[52] U.S. Cl. ..... 313/336; 313/351; 313/346 R; 313/346 DC

[58] Field of Search ..... 313/309, 336, 313/351, 346 R, 346 DC; 250/423 F

[56] References Cited

U.S. PATENT DOCUMENTS

| | | | |
|---|---|---|---|
| 5,034,612 | 7/1991 | Ward et al. | 250/423 R |
| 5,616,926 | 4/1997 | Shinada et al. | 250/423 F |
| 5,763,880 | 6/1998 | Nisiyama et al. | 250/310 |
| 5,838,096 | 11/1998 | Shinada et al. | 313/336 |

OTHER PUBLICATIONS

"Operational experience with zirconiated T–F emitters", J.E. Wolfe, *J. Vac. Sci. Technol.* 16(6), Nov./Dec. 1979, pp. 1704–1708.

*Primary Examiner*—Sandra O'Shea
*Assistant Examiner*—Michael J. Smith
*Attorney, Agent, or Firm*—Webb Ziesenheim Logsdon Orkin & Hanson, P.C.

[57] ABSTRACT

There is disclosed a long-lived thermal field emission electron gun for use in a scanning electron microscope. The gun has a tungsten tip. The surface of this tip is coated with zirconium, zirconium oxide, titanium or titanium oxide. A wire member is mounted above the front end of the tungsten tip to prevent the coating of zirconium or other material from slipping off.

8 Claims, 2 Drawing Sheets

THERMAL FIELD EMISSION ELECTRON GUN

BACKGROUND OF THE INVENTION

1. Field of the Invention

The present invention relates to a scanning electron microscope and, more particularly, to a thermal field emission electron gun comprising an emitter tip that is heated and applied with an electric field to eject electrons from the tip.

2. Description of the Prior Art

A thermal field emission electron gun comprising an emitter tip that is heated and applied with an electric field to eject electrons from the tip is used as an electron gun in a scanning electron microscope or other similar instrument. In the 1970s, an electron gun using a Schottky type emitter was developed as this kind of electron gun. This type of electron gun is described in detail in *J. Vac. Sci. Technol.,* 16, p. 1704 (1979).

The emitter of the Schottky type electron gun is shown in FIG. 1, where to pins 2 and 3 are attached to a ceramic insulator disk 1. A tungsten wire 4 bent into a hairpin is stretched between the two pins 2 and 3. A cylindrical tungsten tip 5 of a single crystal is welded to the protruding front end of the tungsten wire 4. Usually, this tungsten tip 5 consists of a (100) single crystal and has a diameter of about 125 $\mu$m.

This tungsten tip 5 is obtained by welding the single-crystal tungsten to the tungsten wire 4 in the form of a hairpin and then electrolytically polishing the front end of the single-crystal tungsten into a needle-like form. This needle-like tip makes an angle of approximately 10 to 30°.

After the tungsten tip 5 is machined as described above, it is coated with zirconium hydride ($ZrH_2$), 6, and sintered. The zirconium hydride coating 6 is oxidized by the heating and becomes a mass of zirconium (Zr) or zirconium oxide ($ZrO_2$), which is essential to forming a monolayer of zirconium at the tip of the single-crystal tungsten. The (100) plane of the thermal field emission electron gun with such a coating has a decreased work function and so the gun exhibits high brightness and long life.

The Schottky type emitter is fabricated by the processing described above. The principle of operation of the electron gun using this emitter is described by referring to FIG. 2. A heating power supply 7 is mounted between the two pins 2 and 3, which in turn are affixed to the insulator disk 1. This power supply 7 electrically energizes the tungsten wire 4 via the pins 2 and 3.

A suppressor electrode 8 is mounted to the insulator disk 1 so as to cover the disk 1 except for the front end of the tungsten tip 5. A suppressor power supply 9 applies a negative potential to the suppressor electrode 8 with respect to the tungsten tip 5. An extraction electrode 10 is mounted close to the front end of the tungsten tip 5. An extraction voltage is applied to the extraction electrode 10 from an extraction voltage source 11. An accelerating electrode (not shown) is positioned in front of the extraction electrode 10 such that an accelerating voltages is applied between the tungsten tip 5 and the accelerating electrode.

In the structure described above, a heating current is supplied to the tungsten wire 4 from the heating power supply 7 to heat the tungsten wire 4 up to approximately 1800 K. The extraction voltage, normally about 1 to 6 kV, is applied between the tungsten tip 5 and the extraction electrode 10 from the extraction voltage source 11.

As a result, electrons are extracted from the front end of the tungsten tip 5, accelerated to 3 kV, for example, by the accelerating electrode (not shown), and sharply focused onto a specimen by condenser lenses and an objective lens. The suppressor electrode 8 is put at a negative potential with respect to the tungsten tip 5 by the application of voltage from the suppressor power supply 9. Consequently, the thermal emission from the tungsten tip 5 is suppressed except from the front end.

In the thermal field emission electron gun of the construction shown in FIG. 2, the sintered zirconium 6' (Zr of $ZrO_2$) coated on the tungsten tip 5 wears down with the lapse of time. This phenomenon is especially conspicuous at the interface between the tungsten tip 5 and the zirconium mass 6'. This interface is shown in the cross section of FIG. 3. That is, a gap 12 is created between the tungsten tip 5 and the zirconium mass 6'.

If this gap 12 forms and grows to about 10 $\mu$m, the zirconium mass 6' slips off because the tungsten tip 5 is cylindrical in shape. This stops the generation of the electron beam from the tungsten tip 5. This slip occurs earlier than the wear of the zirconium itself and thus determines the life of this kind of thermal field emission electron gun.

SUMMARY OF THE INVENTION

In view of the foregoing circumstances, the present invention has been made. It is an object of the invention to provide a thermal field emission electron gun in which a mass of zirconium is prevented from slipping off, thus prolonging the lifetime.

This object is achieved by a thermal field emission electron gun comprising a tungsten tip, a coating formed on the surface of the tip above the front end of the tip, and a slip preventive member mounted above the front end of the tungsten tip. This slip preventive member prevents the coating from slipping off.

In one feature of the invention, one or more grooves are formed above the front end of the tungsten tip described above to prevent the coating from slipping off.

Other objects and features of the invention will appear in the course of the description thereof, which follows.

DESCRIPTION OF THE PREFERRED EMBODIMENTS

Figure 1:
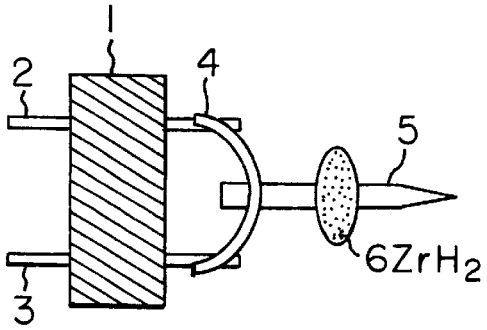
FIG. 1 PRIOR ART
FIG. 1 is a side elevation of the emitter of the prior art thermal field emission electron gun.
Figure 3:
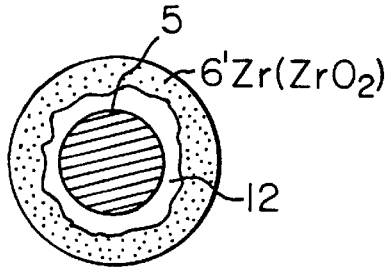
FIG. 3 PRIOR ART
FIG. 3 is cross-sectional view of a tungsten tip and a zirconium mass shown in FIGS. 1 and 2, illustrating the interface between the tungsten tip and the zirconium mass.
Figure 2:
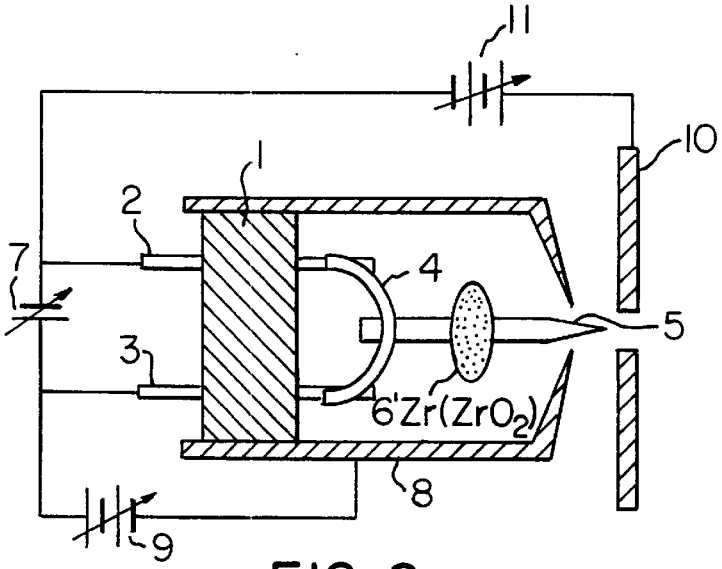
FIG. 2 PRIOR ART
FIG. 2 is a side elevation partly in cross section of main portions of the electron gun shown in FIG. 1.
Figure 4:
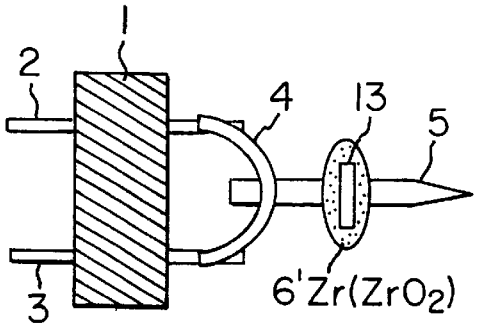
FIG. 4 is a side elevation of main portions of a thermal field emission electron gun in accordance with the present invention.

Referring to FIG. 4, there is shown main portions of a thermal field emission electron gun in accordance with the present invention. It is to be noted that like components are denoted by like reference numerals in various figures and that those components which have been already described in connection with FIGS. 1 and 2 will not be described in detail below.

A tungsten wire 13 is spot-welded to a central portion of the tungsten tip 5. A slurry of zirconium hydride ($ZrH_2$), or zirconium hydride dispersed in a solvent, is applied to this wire 13. The slurry is sintered by heating at about 1800 K. As a result, a mass of zirconium 6' is obtained.

The electron gun constructed as described above is operated. Normal heating at about 1800 K wears down the zirconium mass 6' in a normal manner. In this embodiment, however, if a gap of about 30 $\mu$m is formed at the interface between the zirconium mass 6' and the tungsten tip 5, the wire 13 prevents the zirconium mass 6' from slipping off, otherwise the generation of the electron beam would be stopped. Thus, a long-lived electron gun is provided. This zirconium hydride coating is wider in surface area than in the case of FIG. 1. Therefore, it is easier to apply the slurry of zirconium hydride. At the same time, the zirconium hydride is less likely to slip off prior to the sintering.

Figure 5:
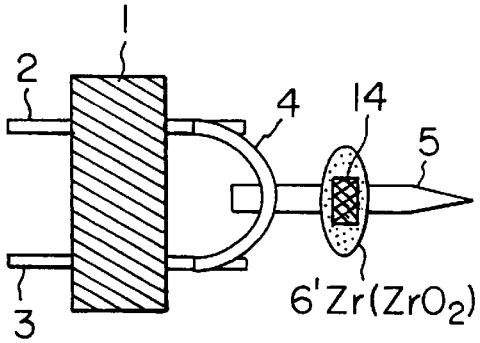
FIG. 5 is a side elevation similar to FIG. 4 but showing another electron gun in accordance with the present invention.

Referring next to FIG. 5, there is shown an electron gun that is similar to the electron gun shown in FIG. 4 except that a mesh member 14 made of fine wires of tungsten is used instead of the wire 13. This mesh member 14 is wound around the tungsten tip 5 and spot-welded to it. This mesh member 14 yields the same advantages as the wire shown in FIG. 4.

Figure 6:
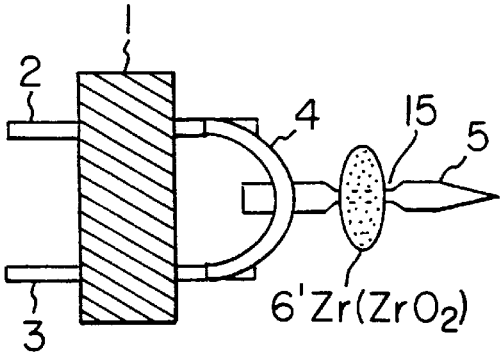
FIG. 6 is a side elevation similar to FIG. 4 but showing a further electron gun in accordance with the present invention.

Referring next to FIG. 6, there is shown an electron gun that is similar to the electron gun shown in FIG. 4 except that a groove 15 about 30 $\mu$m deep is formed in the tungsten tip 5 by electropolishing or other method instead of using a wire or a mesh member. Zirconium hydride is applied to this groove. The mass of zirconium 6' does not slip off until the inside diameter of a gap formed in the groove 15 reaches the diameter of the needle-like tip 5.

Figure 7:
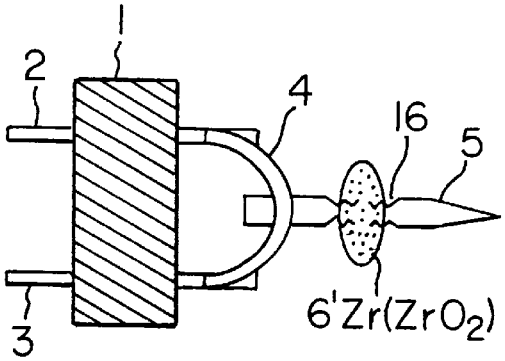
FIG. 7 is a side elevation similar to FIG. 4 but showing a still other electron gun in accordance with the present invention.

Referring now to FIG. 7, there is shown a further electron gun in accordance with the present invention. In this embodiment, a plurality of grooves 16 prevent the mass of zirconium from slipping off in the same way as the single groove in the embodiment illustrated in FIG. 6.

While some preferred embodiments of the present invention have been described, it is to be understood that the invention is not limited to them. Rather, various changes and modifications are possible. In the embodiments described above, zirconium is coated on the tungsten tip and sintered. Instead, zirconium oxide, titanium or titanium oxide may be applied with equal utility to the tungsten tip.

Having thus described our invention with the detail and particularity required by the Patent Laws, what is desired protected by Letters Patent is set forth in the following claims.

What is claimed is:

1. A thermal field emission electron gun comprising:

a tungsten needle-like tip having a tapered front end from which electrons are emitted;

a solid coating formed on a surface of said tungsten needle-like tip, a solid coating member spaced from the tapered front end; said solid coating member supplying coating material to the tapered front end of the tungsten tip; and a slip preventive member mounted and spaced from the tapered front end of the tungsten tip for preventing said solid coating member from slipping off.

2. The thermal field emission electron gun of claim 1, wherein said coating member is made from zirconium or zirconium oxide.

3. The thermal field emission electron gun of claim 1, wherein said coating member is made from titanium or titanium oxide.

4. The thermal field emission electron gun of any one of claims 1–3, wherein said slip preventing member is made of wire.

5. The thermal field emission electron gun of any one of claims 1–3, wherein said slip preventing member is made of a mesh member.

6. A thermal field emission electron gun comprising:

a tungsten needle-like tip having a front tapered end from which electrons are emitted;

a solid coating formed on a surface of said tungsten tip, a solid coating member spaced from the tapered front end said solid coating member supplying coating material to the tapered front end of the tungsten tip; and at least one groove formed and spaced from the tapered front end of the tungsten tip for preventing said solid coating member from slipping off.

7. The thermal field emission electron gun of claim 6, wherein said coating member is made from zirconium or zirconium oxide.

8. The thermal field emission electron gun of claim 6, wherein said coating member is made from titanium or titanium oxide.

* * * * *

UNITED STATES PATENT AND TRADEMARK OFFICE

CERTIFICATE OF CORRECTION

PATENT NO. : 5,962,961

DATED : October 5, 1999

INVENTOR(S) : Iwao Sakai et al.

It is certified that error appears in the above-identified patent and that said Letters Patent is hereby corrected as shown below:

Title Page, insert:

--[30] Foreign Application Priority Data

Nov. 12, 1996 [JP] Japan ..... 8-300526--.

Signed and Sealed this

Twenty-first Day of March, 2000

*Attest:*

*Attesting Officer*

Q. TODD DICKINSON

*Commissioner of Patents and Trademarks*